United States Patent [19]

Corbière

[11] Patent Number: 4,660,261

[45] Date of Patent: Apr. 28, 1987

[54] PROCESS FOR GIVING RELIEF IN SEVERAL DIRECTIONS TO A TEXTILE CLOTH

[75] Inventor: Claude Corbière, La Tour de Salvagny, France

[73] Assignee: Corbiere S.A., La Tour de Salvagny, France

[21] Appl. No.: 709,329

[22] Filed: Mar. 7, 1985

[30] Foreign Application Priority Data

Mar. 15, 1984 [FR] France ..... 84 04234

[51] Int. Cl.[4] ..... D06C 23/04

[52] U.S. Cl. ..... 28/155; 28/163; 26/1; 26/69 R; 223/28

[58] Field of Search ..... 26/1, 69 R, 2 R; 28/155, 163; 8/154; 223/28, 29, 35; 68/7, 8; 428/152, 153, 156, 175, 176

[56] References Cited

U.S. PATENT DOCUMENTS

| | | | |
|---|---|---|---|
| 1,513,054 | 10/1924 | Lipstate | 242/62 |
| 1,592,359 | 7/1926 | Hawk | 242/72 |
| 2,823,444 | 2/1958 | Davies et al. | 428/176 X |
| 2,869,976 | 1/1959 | Cole | 8/150 X |
| 2,971,241 | 2/1961 | Clendening, Jr. | 26/1 |
| 3,325,871 | 6/1967 | Thompson | 28/155 X |
| 3,425,110 | 2/1969 | Willis . | |
| 3,922,404 | 11/1975 | Priester . | |
| 3,987,519 | 10/1976 | Potosnak et al. . | |

FOREIGN PATENT DOCUMENTS

| | | | |
|---|---|---|---|
| 2168116 | 8/1973 | France . | |
| 45-36360 | 11/1970 | Japan | 28/155 |
| 59-43165 | 3/1984 | Japan | 26/1 |

*Primary Examiner*—Robert R. Mackey

*Attorney, Agent, or Firm*—Parkhurst & Oliff

[57] ABSTRACT

The invention relates to a process for giving relief in several directions to a textile cloth, characterized in that it consists:

in known manner, in winding this cloth on a support tube, then in withdrawing said tube, thereafter in compressing the roll longitudinally along the axis of said support, finally, in fixing the roll thus compressed.

The invention is more particularly applicable to fabric for home furnishings or clothes.

2 Claims, 7 Drawing Figures

PROCESS FOR GIVING RELIEF IN SEVERAL DIRECTIONS TO A TEXTILE CLOTH

BACKGROUND OF THE INVENTION

The present invention relates to a novel process for giving relief in several direction to a textile cloth; it also relates to cloths treated in this way.

It is well known to produce cloths pleated longitudinally (direction of warp) or transversely (direction of weft). The invention envisages a novel process for giving relief effects in several directions, i.e. both in the warp direction and in the weft direction.

SUMMARY OF THE INVENTION

The process according to the invention for giving relief in several directions to a textile cloth, is characterized in that it consists:

in known manner, in winding this cloth on a support tube, then in withdrawing said tube, thereafter in compressing the roll in the longitudinal direction of said support, finally, in fixing the roll thus compressed.

Advantageously, in practice:

the roll is formed by a plurality of superposed wraps wound on one another under a usual tension;

once the roll is terminated, a rigid mandrel is introduced into the support tube, the outer diameter of said mandrel being notably less than the inner diameter of said support, then this support tube is withdrawn and the roll is compressed in the longitudinal direction, i.e. along the axis of said mandrel;

the roll is compressed longitudinally by tightening it on its two edges, for example by applying a force on plates sliding on the rigid mandrel;

the deformations thus communicated are set by hot wet steam, particularly in an oven, then the cloth is unwound and presented in conventional manner.

In a variant embodiment, the fabric is wound on the rigid support, interposing between each wrap a compressible interposed element, such as for example a material in plastic foam sheet form; this foam advantageously presents a heat-adhesive face, with the result that, during treatment, this face adheres to the cloth and leads to a foam-line product. The cloth is a warp and weft fabric made of synthetic fibers. In another variant, the initial roll, after having been withdrawn from the support tube, is disposed freely in S form about an odd number of parallel bars of which only two are enveloped by the interior of said roll, while the others are enveloped by the exterior of this roll which then surrounds them in double thickness.

In another variant, the initial roll, after having been withdrawn from the support tube, is disposed freely about a plurality of pairs of bars enveloped alternately by the interior then by the exterior of said roll in one single thickness.

In another variant, the initial roll, after having been withdrawn from the support tube, is placed in a tube to be compressed longitudinally.

The cloth is a warp and weft fabric of natural fibers coated with resin enabling it to confer a thermoplastic character thereto.

The cloths, particularly the fabrics treated in this way, are characterized by a succession of raised patterns in the form of diamonds or diamond tips disposed in several directions, both in warp and in weft, the dimensions of these elements in relief being variable or not along the warp and being homogeneous or not.

If a single support tube is used, the smaller the radius of curvature of said tube, the more the patterns will have small dimensions and will be heterogeneous from the beginning of the piece to the end. On the other hand, if the radius of curvature is large, the pattern will be long and substantially homogeneous from the beginning of the piece to the end.

In a variant, if small patterns which are homogeneous from the beginning of the piece to the end are desired, a plurality of small-diameter spindles are used, about which is disposed said roll obtained on an initial large-diameter mandrel after having withdrawn said initial support. Depending on the arrangement of the spindles, regular or irregular patterns are obtained.

BRIEF DESCRIPTION OF THE DRAWINGS

The invention will be described further with reference to the attached drawings, in which.

DETAILED DESCRIPTION OF THE INVENTION

The manner in which the invention may be carried out and the advantages following therefrom will be more readily understood on reading the following examples given by way of indicative but non-limiting example.

EXAMPLE 1

On a hollow plastic tube or an inflated elastic tube with an outer diameter of 40 mm. There are wound fifty meters of a warp and weft fabric, 160 cm wide, made of polyester yarns, taffeta weave, weighing 65 grams/linear meter.

This winding is effected under a normal tension for this type of operation. A roll 10 of average hardness is thus obtained (see FIG. 1A).

Figure 1:
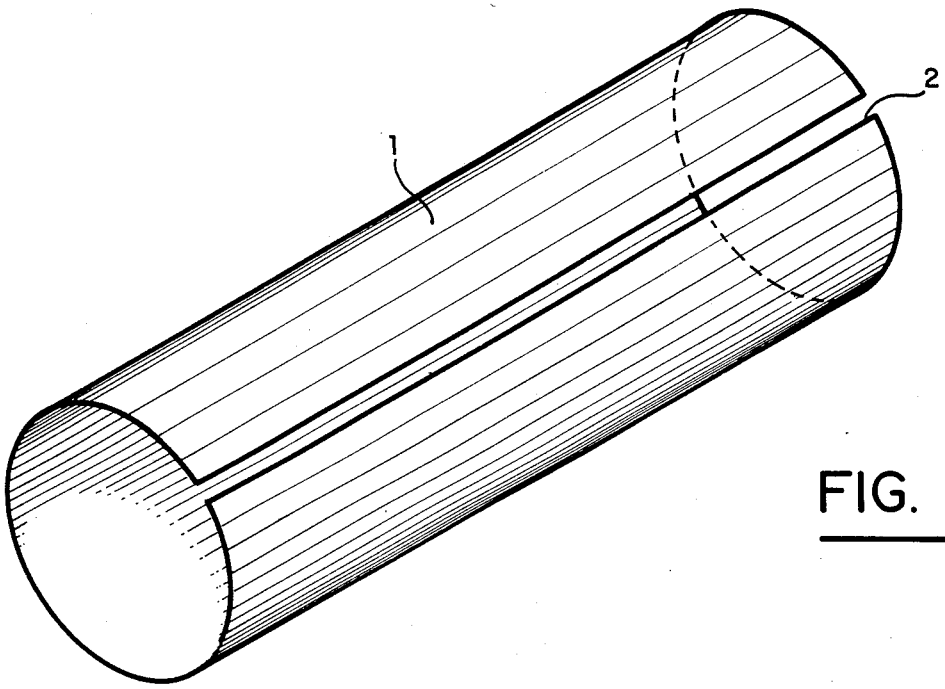
FIG. 1 is a schematic perspective view of a split sheet metal tube used according to the present invention as an initial support.
Figure 1A:
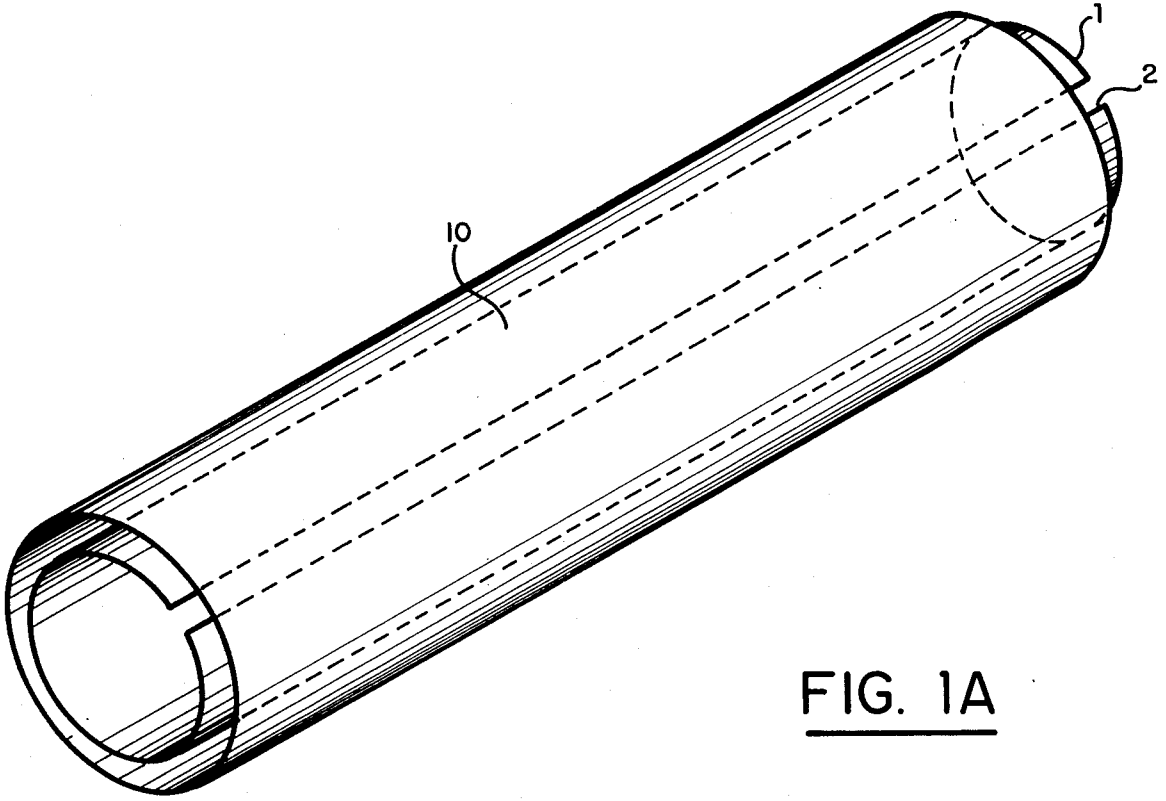
FIG. 1A is a schematic perspective view of the tube on which the fabric is rolled thereon.
Figure 1B:
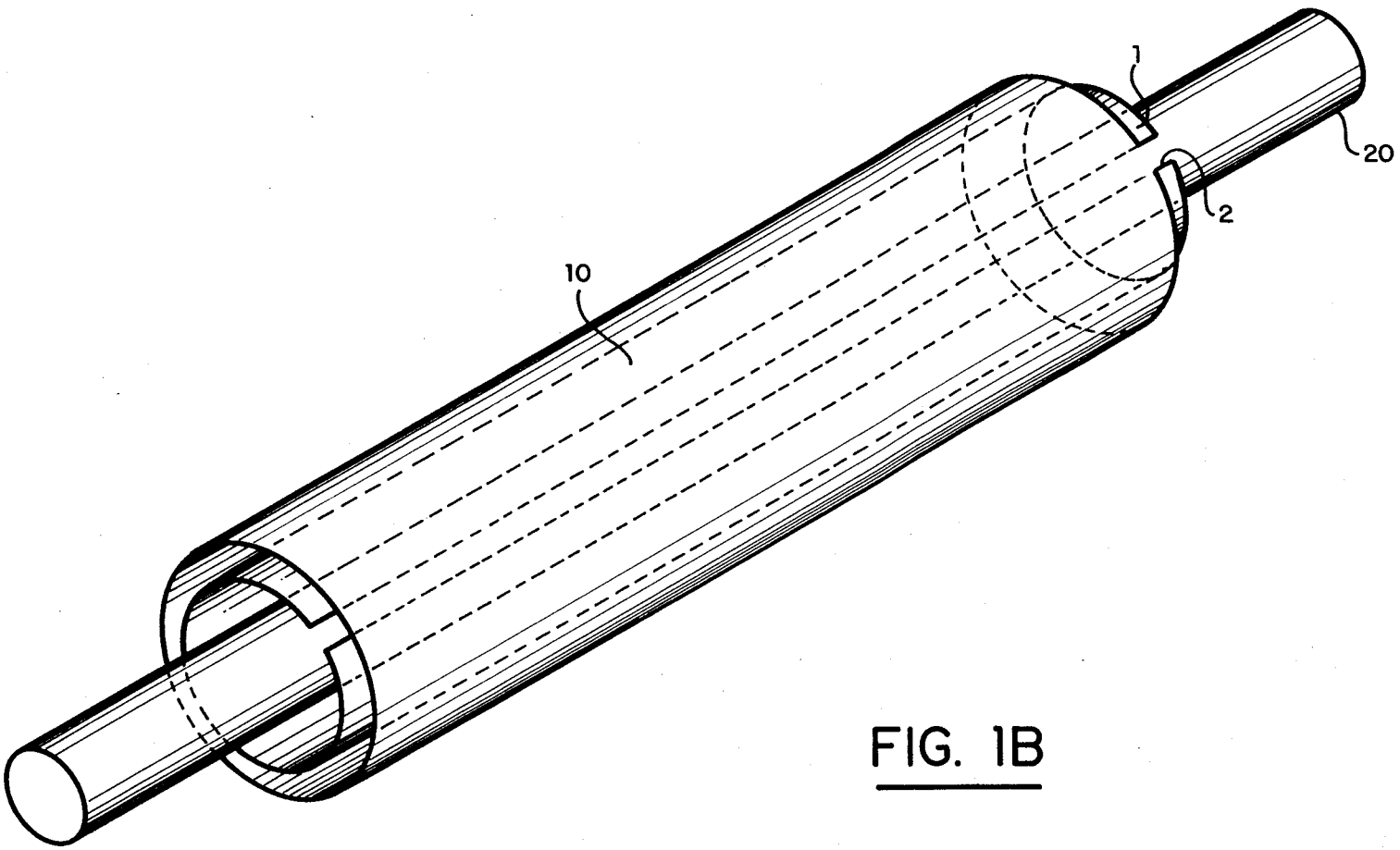
FIG. 1B is a schematic perspective view of the roll of FIG. 1A in which an inner tube is placed within the support tube.
Figure 1C:
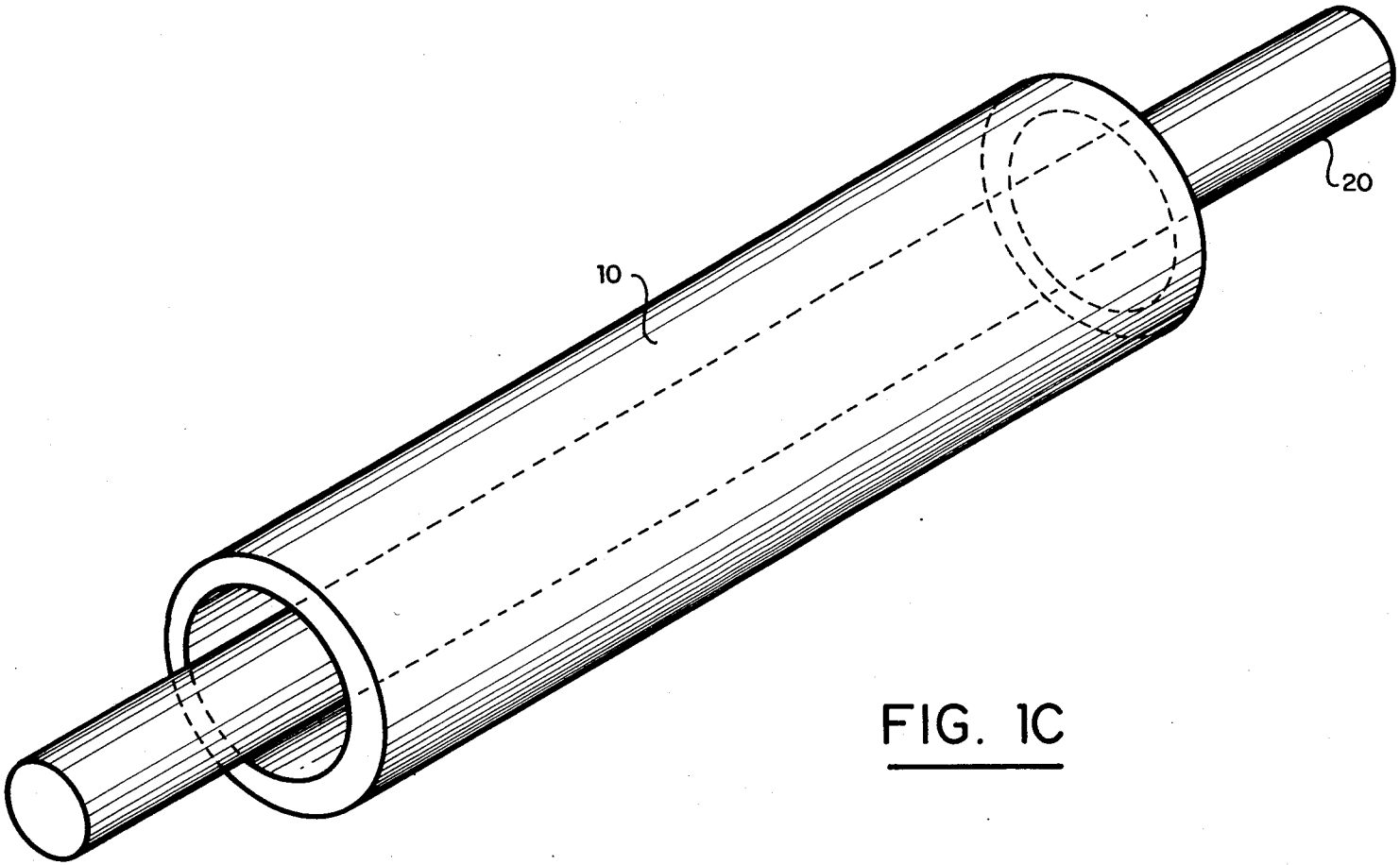
FIG. 1C is a schematic perspective view of the roll with the inner tube, but the support tube removed.

Once the winding is terminated, a second tube 20 made of stainless steel, with an outer diameter of 30 mm, is placed in the first tube (see FIG. 1B), then the first tube is withdrawn (see FIG. 1C).

Figure 1D:
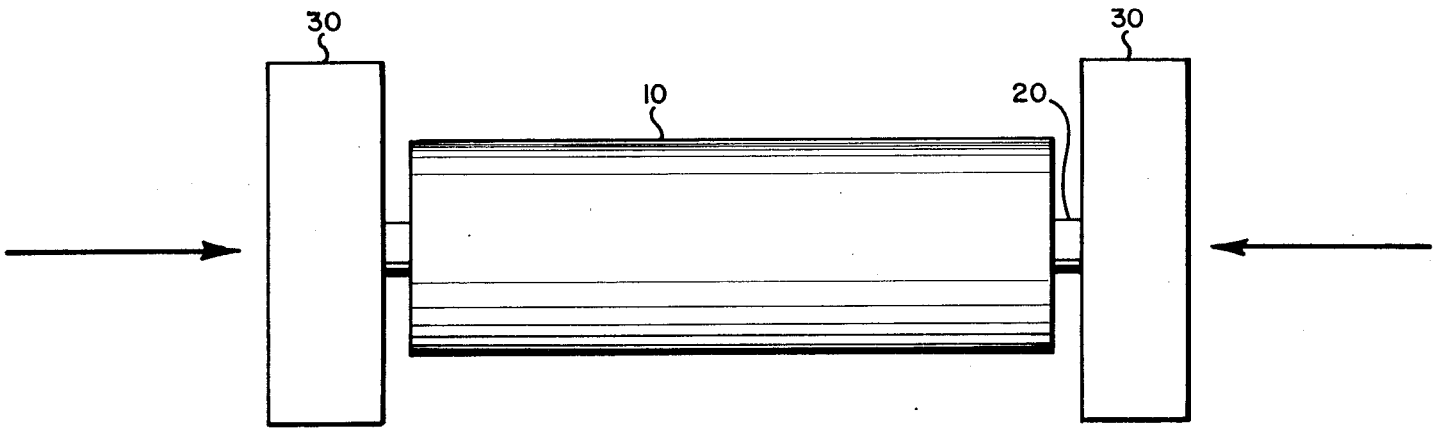
FIG. 1D is a schematic view of the roll with sliding rings for compression of the roll.
Figure 3:
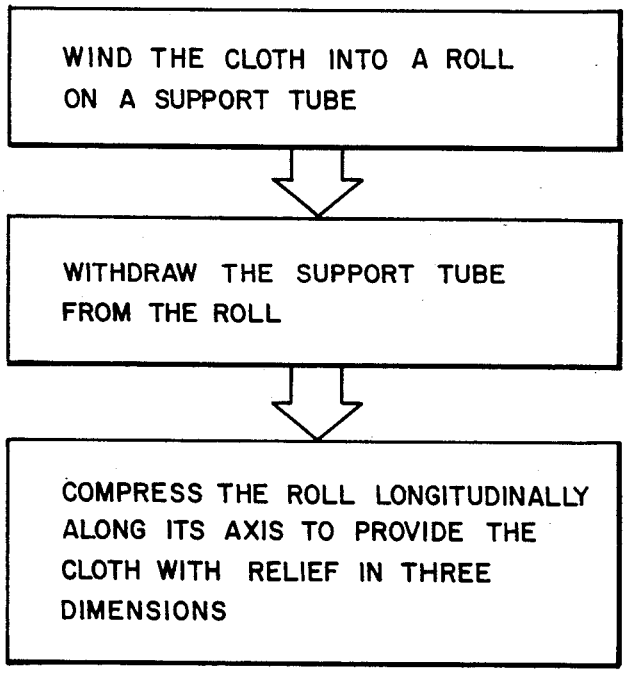
FIG. 3 is a flow chart illustrating the steps in accordance with the presently claimed invention.

Sliding rings 30 (see FIG. 1D) are introduced on each end of this second tube. These sliding rings are then brought as close as possible to each other, and they abut on the edges of the roll, thus compressing the latter in the longitudinal direction along the generatrix of the second mandrel. This type of compression is known to those skilled in the art, for example, as disclosed in U.S. Pat. No. 3,325,871 (the disclosure of which is herein incorporated by reference) in which compression is accomplished without withdrawal of the first support tube. When maximum compression of the roll is obtained, the sliding rings are blocked by cotter pins.

The roll thus compressed is then placed for thirty minutes in a saturating vapour over at 140° C.

After cooling and unwinding, a fabric is obtained which presents a series of elements in relief in all directions, which resemble diamonds or diamond tips. The dimensions of these figures and deformations increase from the interior of the roll towards the outside thereof, as a function of the increase in diameter of the roll. New and original effects are thus obtained by this geometry which varies from the beginning of the piece of the end.

EXAMPLE 2

The previous example is repeated, replacing the first support tube by a rigid tube 1 made of sheet steel, as shown in FIG. 1. This sheet is split along a generatrix 2. This tube this split has an outer circumference of one meter.

Once the fifty meters of the same fabric have been wound, a rigid plate is placed on each end of this tube, said rigid plate being pierced with a hole whose diameter (32 cm) corresponds to the outer diameter of the tube. This roll is then compressed on its two edges. The compression thus given provokes reduction of the diameter of the support tube and longitudinal crushing of the wraps.

Setting is effected under the same conditions as in Example 1, i.e. in a wet oven at 140° C.

Due to the large radius of curvature of the initial support tube, the pattern obtained presents larger dimensions than in Example 1. On the other hand, from the beginning of the piece to the end, the pattern obtained is substantially homogeneous.

EXAMPLE 3

A roll is made under the same conditions as in Example 2. Once the roll is obtained, the support tube split along its generatrix is removed and this roll is disposed in quincunx around five parallel rigid spindles fixed on a plate.

This initial roll is disposed freely in S form around these bars which are enveloped, two by the interior of the roll and three by the outside thereof in double thickness.

The S-shaped stack thus obtained is then compressed longitudinally.

The deformation is set under the same condition as in Example 1.

The patterns obtained are substantially homogeneous from the beginning of the cloth to the end and are formed by a succession of small, then medium, and finally large patterns, the ensemble being repeated homogeneously from the beginning of the piece to the end.

EXAMPLE 4

A roll is made under the same conditions as in Example 2.

Figure 2:
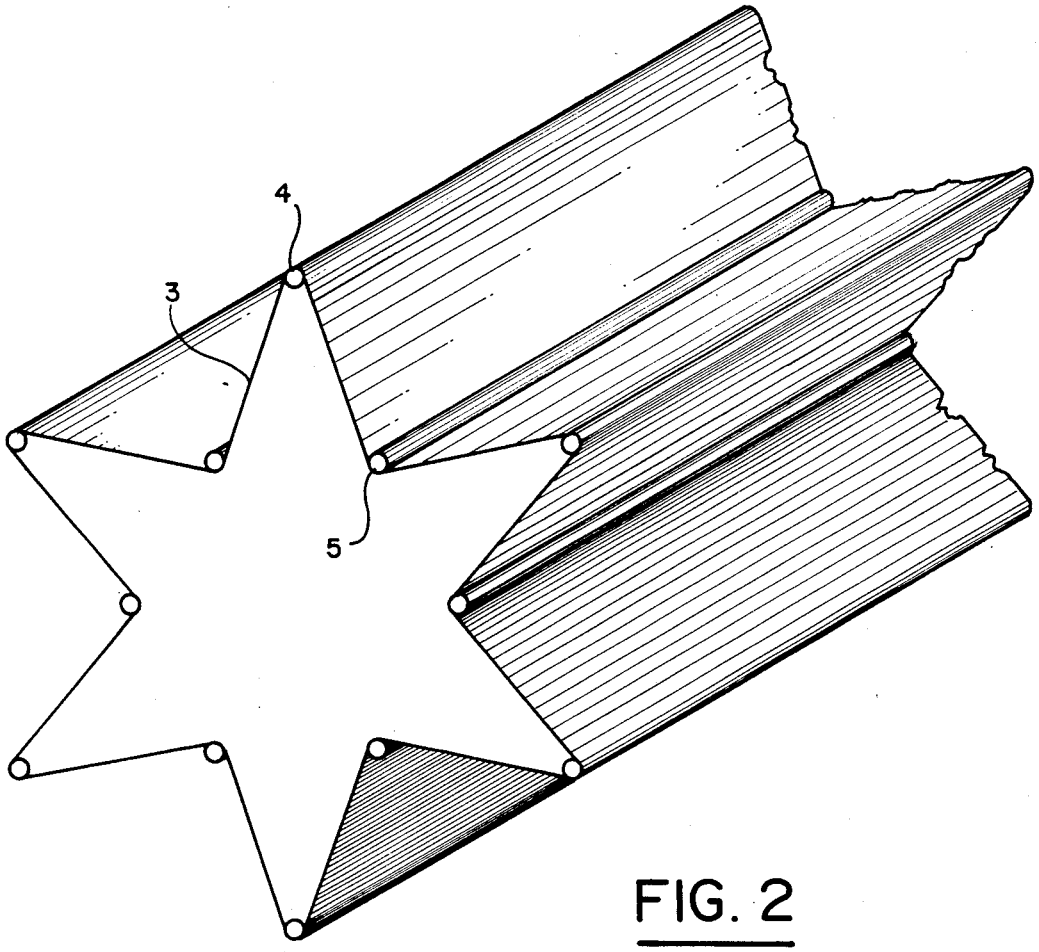
FIG. 2 is a schematic perspective view of an end of a roll of fabric disposed according to the present invention in a quinqunx around 12 parallel bars.

After the rigid split support tube 1 has been withdrawn, as shown in FIG. 2, the roll 3 obtained is disposed in sinusoidal manner around twelve parallel bars 4, 5 disposed in quincunx on either side of a circle having a radius of 120 cm. These bars are alternately placed outside, then inside this circle. The outer bars 5 are enveloped by the interior of the roll, while the inner bars 4 are enveloped by the outside of this roll. This type of arrangement is known to those skilled in the art, for example, as disclosed in U.S. Pat. Nos. 2,971,241 and 2,869,976 (the disclosures of which are herein incorporated by reference) in which the sinusoidal roll is obtained without withdrawal of the support tube.

The stack in ring form thus obtained is then compressed longitudinally.

The deformation is set under the same conditions as in Example 1.

Not only patterns which are homogeneous from the beginning of the piece to the end are obtained, but also, and especially, fine and regular patterns and a regular lengthwise crimp of the fabric which gives it an additional, original bulk.

As has already been stated hereinabove, the cloths treated according to the invention are advantageously made of synthetic fibers, i.e. thermoplastic fibers, so as to present a permanent effect. These cloths with raised patterns may therefore be successfully used for clothes, home furnishings, decoration, particularly for making wall coverings.

What I claim:

1. A process for giving relief in several directions to a textile cloth, comprising the following steps:

winding the cloth into a roll on a support tube;

withdrawing said tube from the cloth roll;

locating the cloth roll freely and sinusoidally about a plurality of pairs of parallel bars such that the bars are enveloped alternately by the interior and then the exterior of the cloth roll;

compressing the cloth roll longitudinally along its axis thereby providing said cloth with three dimensional relief comprising raised patterns in several directions, both in warp and in weft; and fixing the cloth roll thus compressed.

2. The process of claim 1, wherein the deformation of the roll is set thermally by treatment with a wet vapor in an oven.

* * * * *